US008267730B2

(12) United States Patent
Stauch et al.

(10) Patent No.: US 8,267,730 B2
(45) Date of Patent: Sep. 18, 2012

(54) DEVICE FOR CONNECTING TWO ELECTRICAL CONDUCTORS

(75) Inventors: Gert Stauch, Hof (DE); Volker Markgraf, Roeslau (DE); Peter Groetsch, Rehau (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 13/146,708

(22) PCT Filed: Feb. 16, 2010

(86) PCT No.: PCT/EP2010/051883

§ 371 (c)(1), (2), (4) Date: Oct. 5, 2011

(87) PCT Pub. No.: WO2010/097309

PCT Pub. Date: Sep. 2, 2010

(65) Prior Publication Data

US 2012/0021634 A1 Jan. 26, 2012

(51) Int. Cl.
*H01R 4/38* (2006.01)

(52) U.S. Cl. ..... 439/797; 439/948; 439/804; 411/393; 411/383; 411/384

(58) Field of Classification Search ..... None
See application file for complete search history.

(56) References Cited

U.S. PATENT DOCUMENTS

| | | | | |
|---|---|---|---|---|
| 6,280,264 | B1 * | 8/2001 | Whipple et al. | 439/814 |
| 2004/0102081 | A1 | 5/2004 | Buyst et al. | |

FOREIGN PATENT DOCUMENTS

| | | | |
|---|---|---|---|
| DE | 462663 | | 7/1928 |
| DE | 10200423412 | * | 8/2005 |
| DE | 102004023412 | | 12/2005 |
| GB | 2266628 | | 11/1993 |
| GB | 2421642 | | 6/2006 |

OTHER PUBLICATIONS

English Translation of DE 10200423412 (Aug. 2005).*
International Search Report dated May 27, 2010.

* cited by examiner

*Primary Examiner* — Renee S Luebke
*Assistant Examiner* — Harshad Patel
(74) *Attorney, Agent, or Firm* — Sofer & Haroun, LLP

(57) ABSTRACT

The invention relates to a device for connecting two electrical conductors (4, 5), comprising a metallic clamp (1) that is designed as a pipe section and that comprises in the wall thereof at least two through holes provided with a thread for receiving clamping screws (2) provided with an external thread. In the pipe section of the clamp (1), at least one central through hole provided with a thread is furnished between the two through holes in order to receive a fixing screw (3) provided with an external thread, wherein the fixing screw has a tapered, approximately wedge-shaped tip (11), which, in the assembled position, lies rigidly against the end faces of the two conductors (4, 5) inserted into the pipe section. The tip (11) provided with an external thread is screwed into a hole (10) of the fixing screw (3) provided with an internal thread, and the external thread of the tip (1) runs opposite to the external thread of the fixing screw (3).

3 Claims, 3 Drawing Sheets

DEVICE FOR CONNECTING TWO ELECTRICAL CONDUCTORS

RELATED APPLICATIONS

This application is a National Phase application of PCT/EP2010/051883, filed on Feb. 16, 2010, which in turn claims the benefit of priority from European Patent Application No. 09 290 132.1, filed on Feb. 25, 2009, the entirety of which is incorporated herein by reference.

BACKGROUND

1. Field of the Invention

The invention relates to a device for connecting two electrical conductors, composed of a metal clamp constructed from a pipe piece, wherein the clamp has in its wall at least two throughholes provided with a thread for receiving clamping screws provided with an external thread.

2. Description of Related Art

Devices of this type are known and available on the market. They are used, for example, for connecting the conductors of energy cables which are composed preferably of copper or aluminum. For securing and contacting the conductors in the damp, clamping screws are used which are constructed, for example, as shearing screws. The heads of such screws shear off when a certain moment is reached, i.e., when reaching a sufficiently high contact force between screw and conductor.

The contact force produced by the clamping screws effects the connection of the conductor with the clamp and the connection of the individual wires of the conductor. The connection is to be maintained during the entire demanded service life of the device. The electrical current flows in such a device from a conductor through the clamp to the other conductor having relatively high transmission resistances.

In multiple-wire conductors, there is the additional fact that the individual wires of the conductors rub against each other when compacting occurs as a result of tightening the clamping screw. This produces the result that in the interior of the conductor a pressure is produced which is smaller than the pressure at the surface. This may lead to problems when connecting multiple-wire conductors with large cross-sections or in segmented conductors, so called "Milliken" conductors. When the contact of the individual wires in the interior of the conductor is insufficient, heating occurs which is above average. In conductors of aluminum, this heating additionally leads to increased flux of the material and, as a result, after a short time already to a further reduction of the contact pressure. The electrical connection between the conductors becomes then useless relatively quickly.

It is the object of the invention to construct the above-described device in such a way that the electrically conducting connection between the two conductors to be connected can be improved permanently.

In accordance with the invention, the object is met in that in the pipe piece of the clamp between the two throughholes, at least one middle throughhole provided with a thread for receiving a fixing screw provided with an external thread is mounted, which has a narrowing, approximately conical tip which, in the mounted position, rests tightly against the end faces of the two conductors inserted into the pipe piece, the tip provided with an external thread is screwed into a recess of the fixing screw provided with an internal thread, and the external thread of the tip is constructed with an external thread directed oppositely of the external thread of the fixing screw, In this device, the two conductors are connected directly and at least essentially without gaps in the clamp through the conical tip of the fixing screw which tightly rests against the end faces of the two conductors. Consequently, a substantial portion of the current flows through the advantageously conical tip from one conductor to the other. The tight contact of the tip at the end faces of the two conductors is ensured especially by the fact that the tip with a thread which is opposite the external thread of the fixing screw is screwed into the fixing screw. As a result, when tightening the fixing screw, the advance of the tip is greater than the advance of the fixing screw itself This ensures that the tip penetrates deeply into the interior of the clamp and is in the clamp pressed between the end faces of the two conductors, without the pipe piece of the clamp having to have a particularly large wall thickness.

OBJECTS AND SUMMARY

Due to the preferred conical shape of the tip and a low friction of its threads, the produced contact force is high and a permanently current-conducting contact is effected between the end faces of the two conductors and the tip. If the tip is preferably composed. of the same or a similar material as that of the conductors, the current flow between the two conductors is improved. Suitable materials are copper or aluminum and an aluminum alloy or brass.

In a preferred embodiment, the pipe piece of the clamp has at two diametrically oppositely located locations a middle throughhole for receiving a fixing screw provided with a tip. It is also possible to provide more than two throughholes distributed over the circumference of the clamp for receiving fixing screws in the clamp.

BRIEF DESCRIPTION OF THE DRAWINGS

An embodiment of the subject matter of the invention is illustrated in the drawings.

In the drawings.

DETAILED DESCRIPTION

Figure 1:
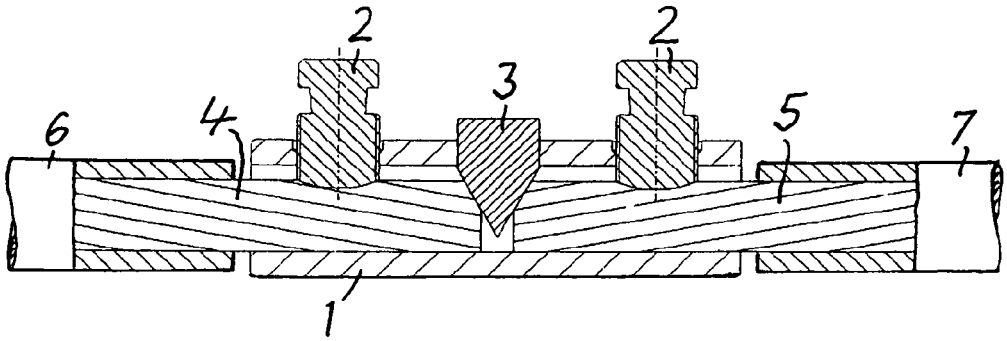
FIG. 1 shows a sectional view of a device according to the invention in a schematic illustration.

In the drawings, all screws are illustrated as shearing screws whose heads are sheared off after reaching the desired tight seat of the screws at the conductors. However, it is also possible to use for the device according to the invention normal, non-shearing screws.

The tip rotabably arranged in the fixing screw is supposed to narrow in the direction of its free end face and constructed preferably conically. However, for simplicity's sake, it is in the following merely referred to as tip.

Figure 5:
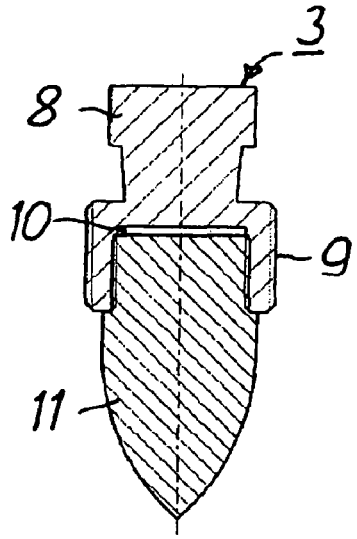
FIG. 5 shows, on a larger scale, a sectional view of a fixing screw used in the device.
Figure 6:
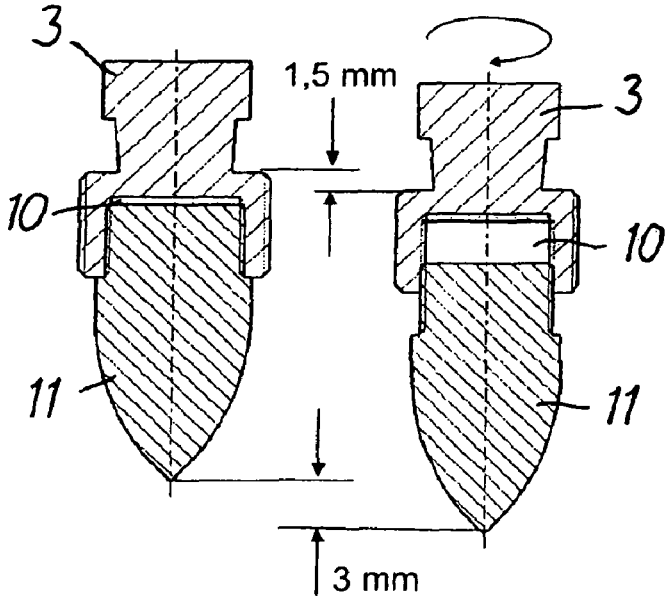
FIG. 6 is an illustration for explaining the manner of operation of the fixing screw.

FIG. 1 shows a clamp which is composed of a galvanized aluminum alloy and is constructed of a pipe piece. The clamp 1 has three throughholes each provided with a thread in which a screw each provided with an external thread is arranged. These screws are a clamping screw 2 each in the lateral throughholes and a fixing screw 3 in the middle throughhole, wherein the exact construction is shown in FIG. 5. Projecting into the clamp 1 from two different sides are the electrical conductors 4 and 5 of two electrical cables 6 and 7. The cables are preferably energy cables. The conductors 4 and 5 are placed closely next each to each other with their end faces, specifically on the level of the middle throughhole for the fixing screw 3. In a preferred embodiment, the conductors are constructed as multiple-wire conductors and are advantageously of aluminum or copper. The conductors 4 and 5 can also be constructed of segments into which individual wires are combined. Such conductors are, for example, Milliken.

In accordance with FIG. 5, the fixing screw 3 has a screw head 8 and a screw body 9 provided with an external thread., The screw body 9 has on its side facing away from the screw head 8 a recess 10 provided with an internal thread into which a tip 11 provided with an external thread is screwed. The two external threads of the screw body 9, on the one hand, and the tip 11, on the other hand, are oppositely directed.

The tip 11 of the fixing screw 3 is advantageously composed of a material which is the same or similar to metal as the conductors 4 and 5 to be connected. Suitable materials are copper and aluminum as well as aluminum alloys and brass. The tip 11 can also be composed of two materials which separated from each other symmetrically relative to their middle axis, so that its one side is composed, for example, of copper, and the other side of aluminum or an aluminum alloy. A fixing screw 3 with a tip constructed in this manner can advantageously be used for connecting an aluminum conductor with a copper conductor. The position of the tip 11 necessary fur this purpose is adjusted prior to tightening of the fixing screw 3.

The surface of the tip 3 may also be structured, For this purpose, it may be roughened or equipped with a plurality of small projections. Such a tip 1 has a somewhat increased surface area. When the tip 11 is advanced, simultaneously a kind of cutting effect occurs, so that the tight seat of the tip 11 against the end faces of the two conductors 4 and 5 is further increased.

The manipulation of the device according to the invention will be explained as an example with the aid of FIGS. 2 to 6.

Figure 2:
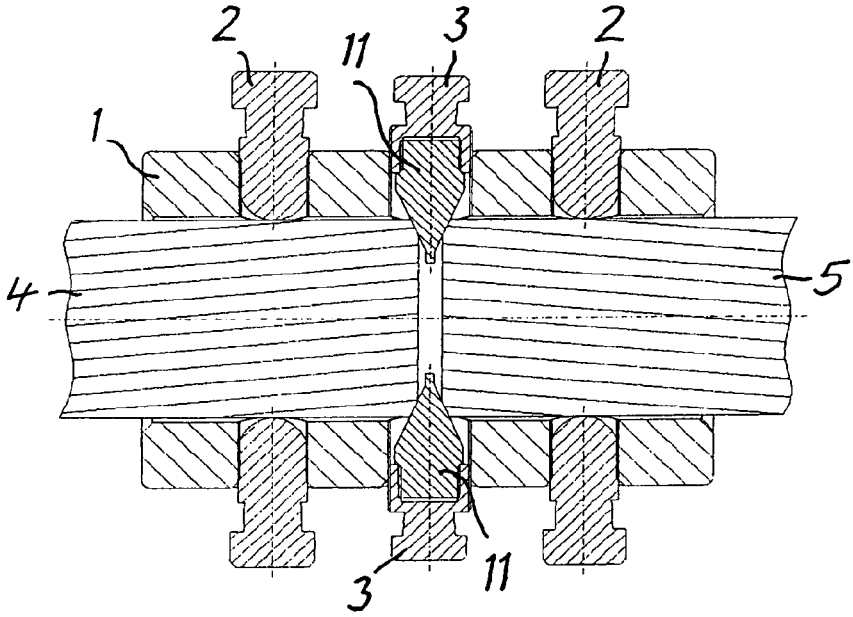
FIG. 2 shows the device according to the invention prior to tightening the screws, also in a sectional view.
Figure 3:
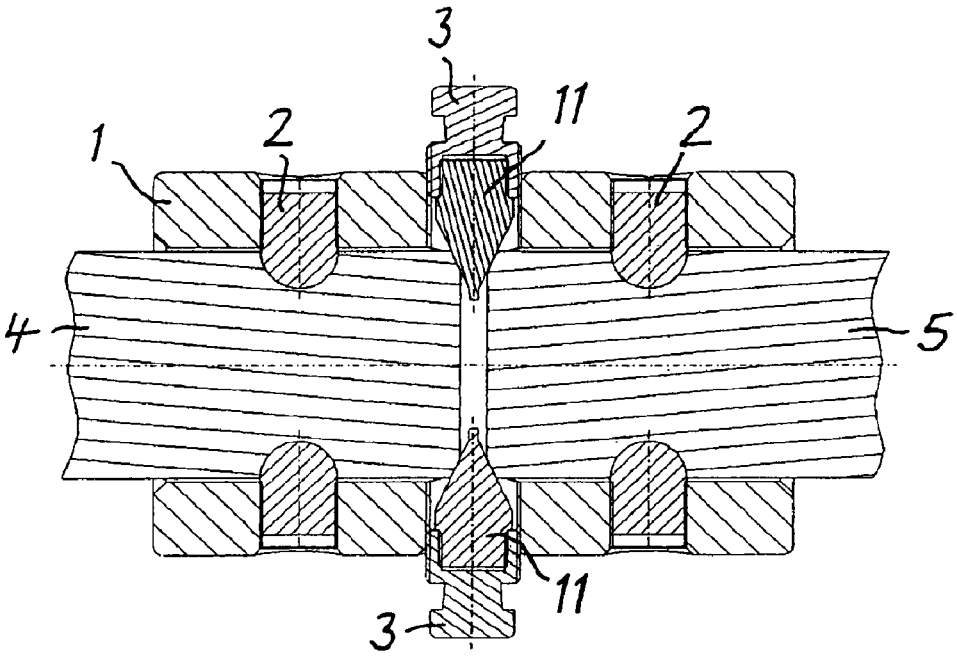
FIG. 3 shows the device according to FIG. 2 after tightening of some of the screws.
Figure 4:
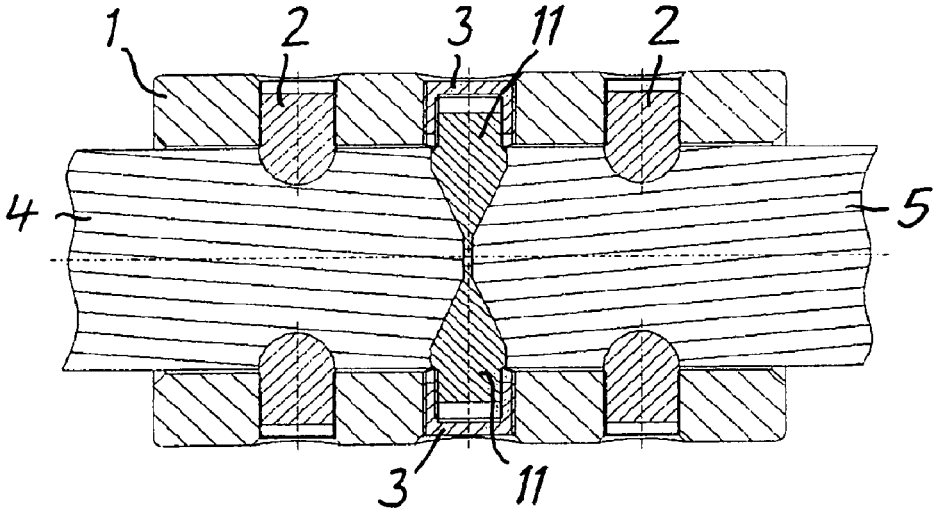
FIG. 4 shows the device according to FIG. 2 after tightening all of the screws.

In the embodiment illustrated in FIGS. 2 to 4, the clamp 1 is equipped with two fixing screws 3 which are located diametrically opposed relative to each other in two middle throughholes. However, it is also possible to use more than two fixing screws 3 which are offset relative to each other in the circumferential direction of the clamp 1 in the same manner as the corresponding middle throughholes.

For producing an electrical connection between the conductors 4 and 5 which is permanently effective, in accordance with FIG. 2, initially two fixing screws 3 are screwed into the clamp 1 until their tips 11 project into the clamp. The clamping screws 2, of which per side of the clamp 1 also two are illustrated located also diametrically opposite of each other, can already be screwed into the throughholes. However, at this point, the screws do not yet project or only insignificantly project into the clamp 1. Subsequently, the two conductors 4 and 5 are pushed into the clamp 1 until they make contact with the tips 11 of the two fixing screws 3. in this position of the conductors 4 and 5, the clamping screws 2 are tightened until they are seated tightly, as is illustrated in FIG. 3. Their heads are sheared off in this end position of the clamping screws 2.

After the conductors 4 and 5, as described, are immovably secured in the clamp 1 by means of the clamping screws 2, the fixing screws 3 are tightened. This causes the tips 11 to penetrate into the gap between the end faces of the two conductors 4 and 5, specifically along a path which is longer than the path which is traveled by the fixing screws 3 as a result of their rotation. In their end position illustrated in FIG. 4, the two tips 11 tightly contact the two conductors 4 and 5. The gap which previously existed between the two conductors 4 and 5, into which the tips 11 are pressed by the rotation of the fixing screws 3 is finally essentially closed by the tips 11. The screw heads 8 of the fixing screws 3 have also been sheared off.

When the fixing screws 3 are turned the advancement of the tips 11 of the fixings screws 3, which is greater than the advancement of fixing screws 3 is effected by the oppositely directed external threads of the screw bodies 9, on the one hand, and the tips 11 on the other hand. A requirement for this longer adjusting path of tips 11 is the fact that the fixing screws 3 are not turned when they are tightened. When this device is used, it can then be assured that the two conductors 4 and 5 contact the tips 11 tightly enough and prevent a rotation of the tips.

The greater advancement of the tip 11 relative to the advancement of the fixing screws 3 itself when the fixing screw 3 is turned, will he explained in connection with an example shown in FIG. 5.

In the case of one turn, the fixing screw 3 is supposed to travel, for example, a distance of 1.5 mm. The tip ii which is held back during the turning of fixing screw 3 is additionally turned during this rotation through its oppositely directed external thread out of the recess 10. If during the rotation of the fixing screw 3 the tip 11 is not rotated together with the fixing screw 3 from the beginning, the tip travels twice the distance as the fixing screw 3. For this example, that is 3.0 mm.

The invention claimed is:

1. Device for connecting two electrical conductors comprising:

a metal clamp constructed as a pipe piece which in its wall has at least two throughholes provided with a thread for receiving clamping screws provided with an external thread, wherein in the pipe piece of the clamp, between the two throughholes, at least a middle throughhole is provided with a thread; the pipe piece holding a fixing screw provided with an external thread having a substantially narrowing conical tip which in the mounted position contacts tightly with end faces of the two conductors when inserted into the pipe piece; wherein the conical tip provided with an external thread is screwed into a recess of the fixing screw provided with an internal thread; and the external thread of the tip is constructed to be oppositely directed to the external thread of the fixing screw.

2. Device according to claim 1, wherein, in the pipe piece of the clamp, two diametrically oppositely arranged middle throughholes are located for receiving fixing screws.

3. Device according to claim 1, wherein the surface of the conical tip is one of roughened or equipped with a plurality of small projections.

* * * * *